US008622126B2

(12) United States Patent
Scott et al.

(10) Patent No.: US 8,622,126 B2
(45) Date of Patent: Jan. 7, 2014

(54) REAMING TOOL

(75) Inventors: Edward D. Scott, Cardenden (GB); Lance S. Davis, Aberdeen (GB)

(73) Assignee: Deep Casing Tools, Ltd., Aberdeen (GB)

( * ) Notice: Subject to any disclaimer, the term of this patent is extended or adjusted under 35 U.S.C. 154(b) by 34 days.

(21) Appl. No.: 12/978,432

(22) Filed: Dec. 24, 2010

(65) Prior Publication Data

US 2011/0100723 A1 May 5, 2011

Related U.S. Application Data

(63) Continuation of application No. PCT/GB2009/001608, filed on Jun. 26, 2009.

(51) Int. Cl.
*E21B 17/14* (2006.01)

(52) U.S. Cl.
USPC ..... 166/242.8

(58) Field of Classification Search
USPC ..... 175/402, 406, 398–400, 57, 321, 171, 175/257; 166/242.8
See application file for complete search history.

(56) References Cited

U.S. PATENT DOCUMENTS

| | | | | |
|---|---|---|---|---|
| 4,854,397 | A * | 8/1989 | Warren et al. | 175/26 |
| 5,119,892 | A * | 6/1992 | Clegg et al. | 175/431 |
| 5,669,943 | A | 9/1997 | Horton et al. | |
| 6,062,326 | A * | 5/2000 | Strong et al. | 175/402 |
| 6,401,820 | B1 * | 6/2002 | Kirk et al. | 166/311 |
| 6,659,173 | B2 | 12/2003 | Kirk et al. | |
| 6,983,811 | B2 | 1/2006 | Wardley | |
| 7,066,253 | B2 | 6/2006 | Baker | |
| 7,275,605 | B2 | 10/2007 | Smith et al. | |
| 2001/0020552 | A1 * | 9/2001 | Beaton et al. | 175/385 |
| 2003/0075364 | A1 | 4/2003 | Wardley | |
| 2005/0183892 | A1 * | 8/2005 | Oldham et al. | 175/402 |
| 2005/0236187 | A1 * | 10/2005 | Chen et al. | 175/61 |
| 2007/0119624 | A1 | 5/2007 | Brady | |

FOREIGN PATENT DOCUMENTS

| | | | |
|---|---|---|---|
| GB | 2333542 | A | 7/1997 |
| GB | 2333542 | A | 7/1999 |
| GB | 2339227 | A | 1/2000 |
| GB | 2429731 | A | 3/2003 |
| GB | 2446742 | A | 8/2008 |
| WO | 9628635 | A1 | 9/1996 |
| WO | 0244514 | A1 | 6/2002 |
| WO | 2005083226 | A1 | 9/2005 |
| WO | WO 2008015402 | A2 * | 2/2008 |
| WO | 10085051 | A2 | 7/2010 |

OTHER PUBLICATIONS

Examination Report: European Patent Application No. 09 679 580.3.
Novelty Search Report, British patent application No. GB0811823.4, Aug. 2, 2008.
International Preliminary Report of Patentability, International Application PCT/GB2009/001608.

* cited by examiner

*Primary Examiner* — Kenneth L Thompson
*Assistant Examiner* — Ronald Runyan
(74) *Attorney, Agent, or Firm* — Richard A. Fagin

(57) ABSTRACT

A reaming shoe for location in a bore has a rotationally balanced nose. A rotary drive is rotationally coupled to the reaming shoe to enable reaming of the bore. The assembly of the reaming shoe and the rotary drive is adapted to be coupled to a tubular component. The reaming shoe is mounted to the tubular component to enable rotation of the reaming shoe independently of the tubular component, such that the reaming shoe is rotatable at a different rotational speed than the tubular component.

15 Claims, 3 Drawing Sheets

REAMING TOOL

CROSS-REFERENCE TO RELATED APPLICATIONS

This is a continuation of International Patent Application No. PCT/GB2009/001608 filed on 26 Jun. 2009. Priority is claimed from British Patent Application No. GB 0811823.4 filed on 27 Jun. 2008.

STATEMENT REGARDING FEDERALLY SPONSORED RESEARCH OR DEVELOPMENT

Not Applicable.

FIELD OF THE INVENTION

This invention relates to a tool for reaming a bore and, in particular, but not exclusively, to a reaming shoe for use in reaming a wellbore.

BACKGROUND OF THE INVENTION

In a number of industries, bores are drilled from surface in order to access subsurface formations, including for example hydrocarbon-bearing or geothermal formations. One method of forming a bore comprises drilling to a first depth and running a first tubular section or string of tubular sections, known as casing, into the bore. The casing is suspended from surface and the annulus between the exterior of the casing and the surrounding bore wall is filled and sealed with cement. The bore is extended and a further tubular section or string of tubular sections, known as liners, are run into the bore and suspended from the casing and the annulus between the exterior of the liner and the surrounding bore wall is also filled and sealed with cement. In order to access the formation, the liner and cement are perforated to provide a fluid flow path between the formation and the surface.

Traditional methods of forming a bore can be both time-consuming and costly. Furthermore, it is common for the tubular string, during run in, to encounter obstructions in the bore, for example, beds of drill cuttings lying on the low side of an inclined bore, ledges, bore discontinuities, set cement or the like which can obstruct location or progress of the tubular string or other bore tools, thereby inhibiting or complicating formation and operation of the bore.

In order to improve the surface texture and geometric tolerances of the bore, the leading end of the tubular string may be provided with a shoe having blades arranged around its exterior surface. The blades are adapted to engage the interior of the bore and, typically, the tubular string is rotated or reciprocated to remove material from the bore wall or clear obstacles in the bore by a reaming process. In some applications, a portion of the shoe may be tapered off bore-centre to provide a nose portion.

SUMMARY OF THE INVENTION

According to a first aspect of the present invention, there is provided a reaming shoe for location in a bore, the shoe comprising a rotationally balanced nose. In one embodiment, the nose has an eccentric profile.

According to a second aspect of the present invention, there is provided a reaming shoe assembly for use in a bore. The assembly includes a reaming shoe for location in the bore.

The shoe comprises a rotationally balanced nose. A rotary drive is rotationally coupled to the reaming shoe to enable reaming of the bore.

In one embodiment, the nose has an eccentric profile.

Other aspects and advantages of the invention will be apparent from the accompanying description and claims.

BRIEF DESCRIPTION OF THE DRAWINGS

These and other aspects of the present invention will now be described, by way of example only, with reference to the accompanying drawings, in which.

DETAILED DESCRIPTION

Figure 1:
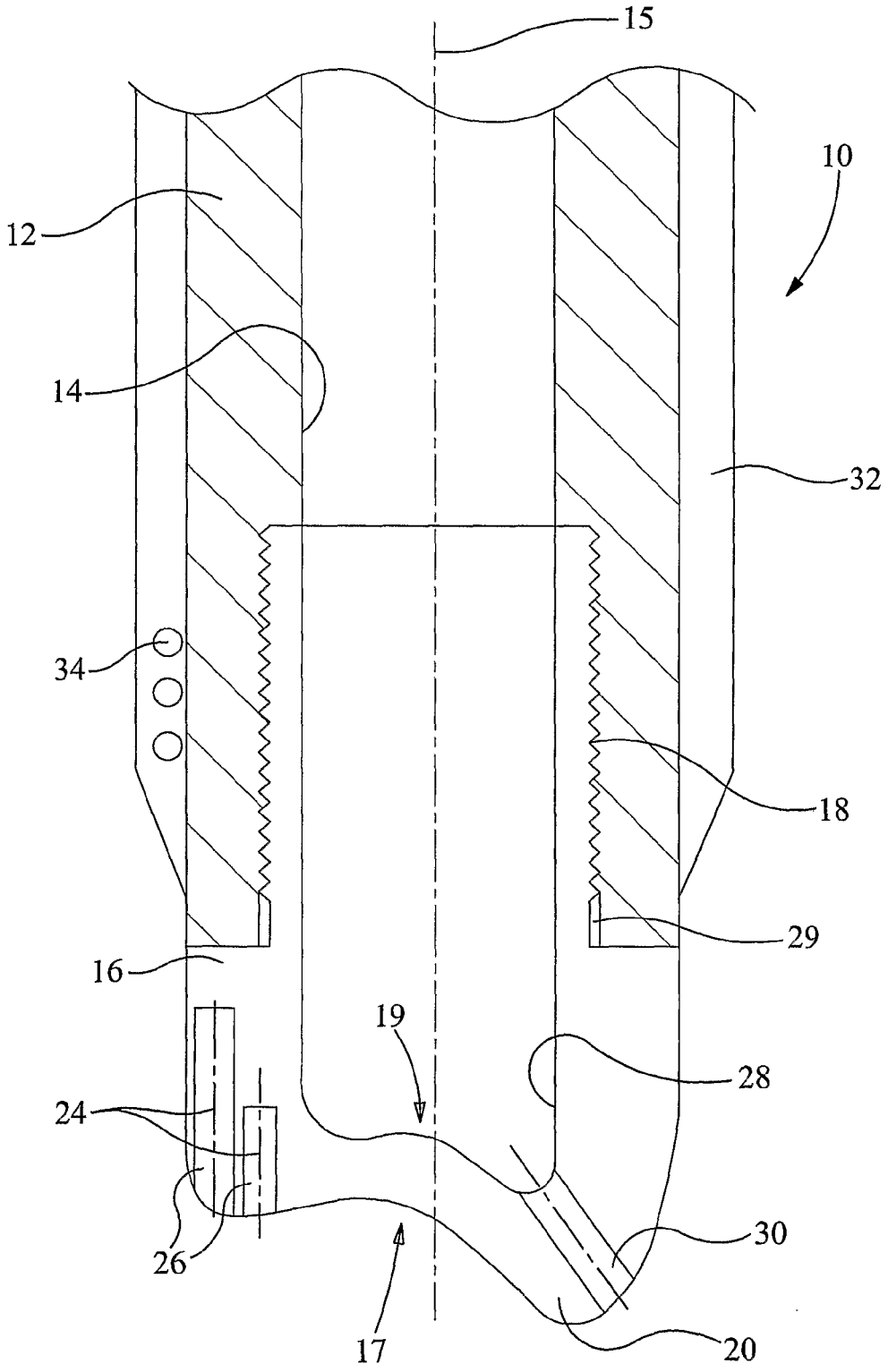
FIG. 1 is a sectional view of part of a reaming shoe according to a first embodiment of the present invention.

The various aspects of the present invention will be described first in general terms, to be followed by a more detailed description with reference to the various specific drawings.

According to a first aspect of the present invention, there is provided a reaming shoe for location in a bore, the shoe comprising a rotationally balanced nose. In one embodiment, the nose has an eccentric profile.

The provision of a rotationally balanced shoe permits relatively high speed rotation of the reaming shoe while substantially eliminating or at least reducing vibration generated by the rotation of the shoe and, in particular, but not exclusively, by rotation of the eccentric nose profile.

The eccentric nose profile may comprise a nose portion arranged to form a leading end of the nose. For example, the eccentric profile may define an off-centre portion resulting in an off-centre mass relative to an axis of the shoe. The axis may, for example, comprise a substantially central longitudinal axis of the shoe, which axis may also comprise the central longitudinal axis of a tubular component to which the shoe may be coupled and/or the bore. The shoe may be adapted to rotate about the shoe axis at a speed which, if unbalanced, would result in accelerated wear and damage to at least one of the shoe, the tubular component and the bore.

The provision of an eccentric nose profile may permit stabbing through bore obstructions, for example ledges in the bore and/or drill cuttings lying on the low side of an inclined bore, to facilitate a reciprocal reaming operation. The eccentric nose profile may be adapted to facilitate stabbing through bore obstructions while also permitting high speed rotation of the shoe.

The shoe may comprise a body. For example, the body and the nose may comprise a single component, the nose being formed on the body. Alternatively, the nose may comprise a separate component adapted to be coupled to the body. The nose may be coupled to the body by any suitable connection. For example, the nose may be coupled to the body by a threaded connector or other mechanical fastener or connector. Beneficially, the nose may be coupled to the body by a connection that permits transmission of torque through the connection, for example, a spline connection, hexagonal drive or other suitable connector. In a further alternative, the nose may be fused to the body, for example, by brazing, adhesive or other suitable bonding process.

The nose may be constructed from any suitable material or combination or materials, including for example a metallic material or alloy, a ceramic material, a polymeric material, a glass material or other suitable material or combination of materials. In particular embodiments, the nose may be constructed from aluminium or aluminium alloy; or a ceramic material.

The shoe may comprise a weighting arrangement adapted to rotationally balance the nose about the shoe axis, whereby vibration induced by rotation of the shoe may be substantially eliminated or at least reduced. Any suitable weighting arrangement may be used. For example, the weighting arrangement may comprise at least one insert provided on at least one of the nose and the body. In particular embodiments, the at least one insert may be provided on an opposing side of the nose from the eccentric portion.

Alternatively, or in addition, the weighting arrangement may comprise at least one insert provided on the body. The at least one insert may be of any suitable form. The insert may comprise a bar, slug or pellet of material of relatively high density. For example, the material may be selected to be of higher density than the nose material such that a relatively small volume insert may be used to rotationally balance the nose. In particular embodiments, the insert may comprise a metallic material such as lead, brass or the like, though any other suitable material may be used.

In an alternative or additional arrangement, the weighting arrangement may comprise at least one bore defining a void. The bore may be provided, for example, in the body such that rotational balancing of the shoe may be achieved by the removal or omission of material from the body.

In a further alternative or additional arrangement, the weighting arrangement may comprise a portion of the nose formed and arranged to rotationally balance the mass of the nose about the shoe axis. In particular embodiments, the nose portion may be formed with the nose as an integral cast-in feature.

The shoe may further comprise at least one reaming element formed on, or mounted to, the shoe. For example, the reaming element may be braised, adhesively bonded or otherwise secured to the shoe. One or more reaming element may be arranged to extend radially to engage the bore to facilitate reaming of the bore. At least one reaming element may be provided on the nose.

The reaming elements may take any suitable form. For example, the reaming elements may comprise at least one reaming rib, blade or the like formed, or mounted to, an exterior surface of the body. The reaming elements may extend around at least a portion of the circumference of the body and may extend in a spiral, helical, serpentine, or other configuration. Alternatively, the elements may extend axially, that is substantially parallel to the shoe axis.

The reaming elements may further comprise a cutting or grinding element or surface, for example polycrystalline diamond compact (PDC) cutters, carbide particles or any other arrangement suitable for assisting in performing the reaming operation.

The weighting arrangement may comprise at least one bore provided in the at least one reaming element to facilitate rotational balancing of the nose. Alternatively, or in addition, the weighting arrangement may comprise at least one insert provided in the at least one reaming element to facilitate rotational balancing of the nose. The insert and/or the bore may be of any suitable form.

The nose and/or the body may define a conduit for directing fluid through the shoe. The nose may further comprise one or more port for permitting fluid to be directed to the exterior of the shoe and in particular embodiments, at least one of the ports may define, or provide mounting for, a nozzle. The provision of a port permits fluid, such as drilling mud or the like, to be directed through the shoe to assist in the removal and/or displacement of an obstruction from the bore. At least one of the ports may be integrally formed in the nose. Alternatively, or in addition, at least one of the ports may comprise a separate component coupled to the nose. The nozzle may be constructed from any suitable material, including a ferrous metal, non-ferrous metal or a material such as ceramic or machinable glass.

The nose may also define, or provide mounting for, at least one cutting structure and, in particular embodiments, the cutting structure may comprise a ceramic cutting structure or the like, ceramic cutting structures beneficially providing excellent shock fracture and cutting properties.

At least one component, or a portion of at least one component, of the shoe may be adapted to facilitate drilling through the shoe. For example, at least one of the shoe, body, nose, insert, reaming element, and fluid port may be constructed from a readily drillable material which may be frangible or otherwise adapted to break. In particular embodiments, the components may be constructed from at least one of aluminium, aluminium alloy, lead, brass, other suitable metallic material; a ceramic material; a polymeric material; a laminate material; a carbon fibre material; and a glass material, though any other suitable material may be used.

Alternatively, or in addition, the nose may further comprise selected portions or regions of weakness. The weaker portions or regions may be cast into the nose during manufacture. Alternatively, or additionally, the nose may be subject to a machining process, or other process, to produce harder and weaker portions or regions. The provision of harder portions or regions may facilitate cutting or reaming of the bore. The provision of selected weaker portions or regions may facilitate drilling through the nose, where required.

The nose may be formed and arranged to avoid the formation of a slug of nose material when drilling through the nose and which may otherwise form an obstruction in the bore. For example, the nose may define a substantially concave distal surface defining an internal projection, upset, dimple or the like. The concave distal surface and projection may be arranged to facilitate gradual cutting away of the nose to avoid the creation of an unsupported end portion which without restraint could form an obstruction in the bore.

According to another aspect of the present invention, there is provided a reaming shoe assembly for use in a bore, the assembly comprising:

a reaming shoe for location in the bore, the shoe comprising a rotationally balanced nose; and a rotary drive adapted to rotate the shoe to permit reaming of the bore.

In one embodiment, the nose has an eccentric profile. The assembly may be adapted for use in reaming a drilled bore or alternatively, the assembly may be adapted for use in reaming a tubular component such as casing, liner or the like.

The rotary drive may be of any suitable type. For example, the rotary drive may comprise a mud powered motor, electric motor or other suitable device adapted to rotate the reaming shoe. The rotary drive may be driven from surface. The assembly may be adapted to be coupled to a tubular component, such as casing, liner or drill pipe. In particular embodiments, the assembly may be adapted to be coupled to a tubular string, such as casing string or drill string and the assembly may be adapted to be run into the bore at a leading end of the tubular string.

The shoe may be adapted to rotate independently of the tubular component. Advantageously, as the shoe may rotate independently of the tubular component, rotation of the tubular component is not required to perform the reaming operation. The shoe may thus be adapted for rotation at a higher speed than the tubular component and, for example, the shoe may be adapted to rotate at a rotational speed that would otherwise result in detrimental vibration to the motor, tubular component or other component of the assembly. In particular embodiments, the shoe may be adapted to rotate at speeds of up to about 800 rpm to 1000 rpm, though the shoe may be adapted for higher rotational speeds where required. This facilitates efficient reaming operation while reducing or eliminating rotational forces on the tubular component.

The assembly may further comprise at least one stabiliser. The stabiliser may be non-rotating or may be free to rotate relative to the shoe.

Alternatively, or in addition, the shoe may assist in stabilising, centralising or otherwise positioning the assembly in the bore. For example, at least one of the reaming ribs may define a helical path to provide stabilisation over the circumference of the shoe. Alternatively, the ribs may be arranged axially and extend radially to provide a degree of stabilisation.

The assembly may further comprise a connector, for example, a substantially tubular connector sub or the like. The connector may be adapted to couple the tubular component to the reaming shoe, for example by a threaded connection, box and pin connection or other suitable connection.

In reference initially to FIG. 1 of the drawings, there is shown a diagrammatic sectional view of a reamer shoe 10 according to an embodiment of the present invention. The shoe 10 is adapted for location in a wellbore (not shown) and comprises a substantially tubular mandrel or body 12 having a central bore 14 located about an axis 15.

A cap or nose 16 is coupled to a distal end portion of the body 12 via a threaded connection 18, though a spline connection, hexagonal drive or other suitable connector may be used to transmit torque through the shoe 10.

As shown in FIG. 1, the nose 16 defines an eccentric offset portion or lobe 20 which extends to a greater axial extent than the remainder of the nose 16. The distal surface of the nose 16 comprises a substantially concave central portion 17. The nose 16 further comprises a projection or dimple 19 on an opposing side of the nose 16 from the concave surface.

The nose 16 is constructed from a metallic material, such as aluminium or brass, though other materials such as ferrous metals, or ceramics may be used where appropriate.

The nose 16 further comprises a number of bores 24, each bore 24 adapted to receive a slug or insert 26 (two inserts 26 are shown in FIG. 1). The inserts 26 are constructed from a slug of material, such as lead or brass, which is of greater density than the material from which the nose 16 is constructed. Due to the distribution of mass in the nose 16, the centre of mass of the nose 16 is located away from the central axis 15. Accordingly, by selection of the mass of the inserts 26, the nose 16 can be balanced about the central axis 15.

The nose 16 further comprises a bore 28 which is substantially aligned with the bore 14 of the body 12 and provides a fluid flow path through the shoe 10. At least one conduit or port 30 is provided in the nose 16, each port providing a fluid conduit between the bores 14,28 and the wellbore (not shown).

Figure 2B:
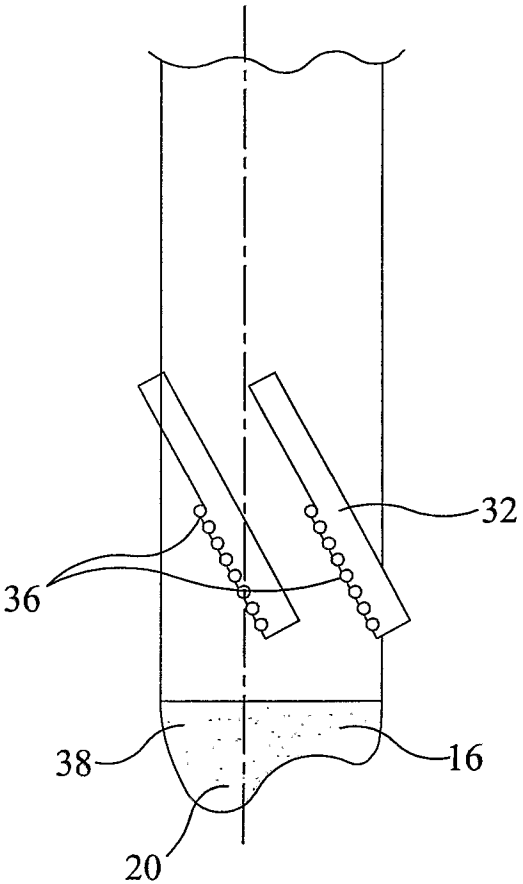
FIG. 2B is a side view of part of a reaming shoe according to another embodiment of the present invention with a second, alternative, blade arrangement.
Figure 2A:
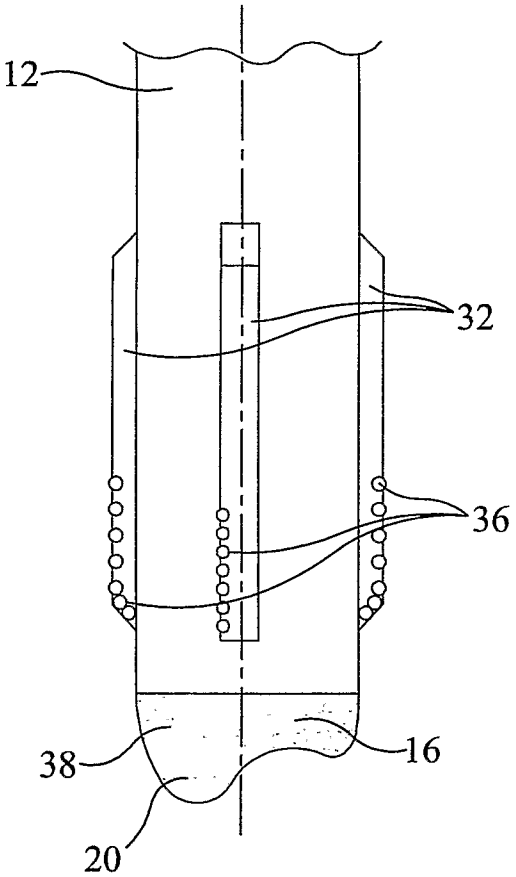
FIG. 2A is a side view of part of the reaming shoe of FIG. 1 having a first blade arrangement.

Referring now also to FIGS. 2A and 2B of the drawings, the shoe 10 further comprises cutting structures in the form of reaming ribs 32. The ribs 32 extend radially from the exterior surface of the body 12 and, as will be described below, in use, the ribs 32 are adapted to engage the bore wall to perform a reaming operation on the wall. In the embodiments shown in the figures, the ribs 32 are integrally formed with the body 12, though the ribs 32 may comprise separate components coupled to the body 12 where appropriate. Any rib arrangement may be employed. By way of example, two rib arrangements are shown in FIGS. 2A and 2B of the drawings. In the arrangement shown in FIG. 2A, the ribs 32 are circumferentially spaced around the exterior surface of the body 12 and extend substantially parallel to the central axis 15. In the arrangement shown in FIG. 2B, the ribs 32 extend helically around the exterior surface of the body 12.

As shown most clearly in FIG. 1, one of the ribs 32 also comprises a number of bores defining voids 34. The provision of the voids 34 in the body 12 further assists in balancing the shoe 10 relative to the central axis 15, where required.

One or more of the components of the shoe 10 are provided with abrasive particles which assist in removing material during operation of the shoe 10. For example, the ribs 32 are provided with cutting or grinding surfaces 36, such as PDC cutters, though carbide particles or other suitable arrangements may be used as required. The outer surface of the nose 16 is also dressed with carbide particles 38 to provide further cutting structures.

The ports 30 in the nose 16 can also be hardened by introducing a skin of hard particulate material applied, for example, by high velocity oxygen fuel spraying (HVOF) or another suitable process.

In use, the shoe 10 is run into a wellbore or tubular component to be reamed (not shown). The lobe 20 enables the shoe 10 to stab or cut through obstructions (not shown) in the wellbore or tubular component without rotation, where required, including for example, ledges or drill cuttings lying on the low side of an inclined bore.

The ribs 32 engage the interior surface of the wellbore or tubular component, rotation or reciprocation of the shoe 10 reaming the wellbore to the required dimension and surface texture. The abrasive particles 36,38 provided on the ribs 32 and nose 16 further assist in performing the reaming operation.

The shoe 10 is adapted to rotate at speeds of up to about 1000 rpm, though higher speeds may be used where appropriate, this facilitating efficient reaming of the wellbore. During rotation, the inserts 26 and/or voids 34 assist in balancing the nose 16 of the shoe 10 to reduce or substantially eliminate vibration generated by forces produced from rotation of the nose 16 about the central axis 15.

Fluid, such as drilling mud or the like (not shown) is directed through the bore 14, the bore 28 and through the port or ports 30 to assist in removing material from the bore. The fluid may then be re-circulated to surface via an annulus (not shown) between the shoe 10 and the bore.

Furthermore, a seal member, such as an o-ring seal 29, is provided between the nose 16 and the body 12 to substantially prevent or reduce leakage of fluid through the connection 18.

Figure 3:
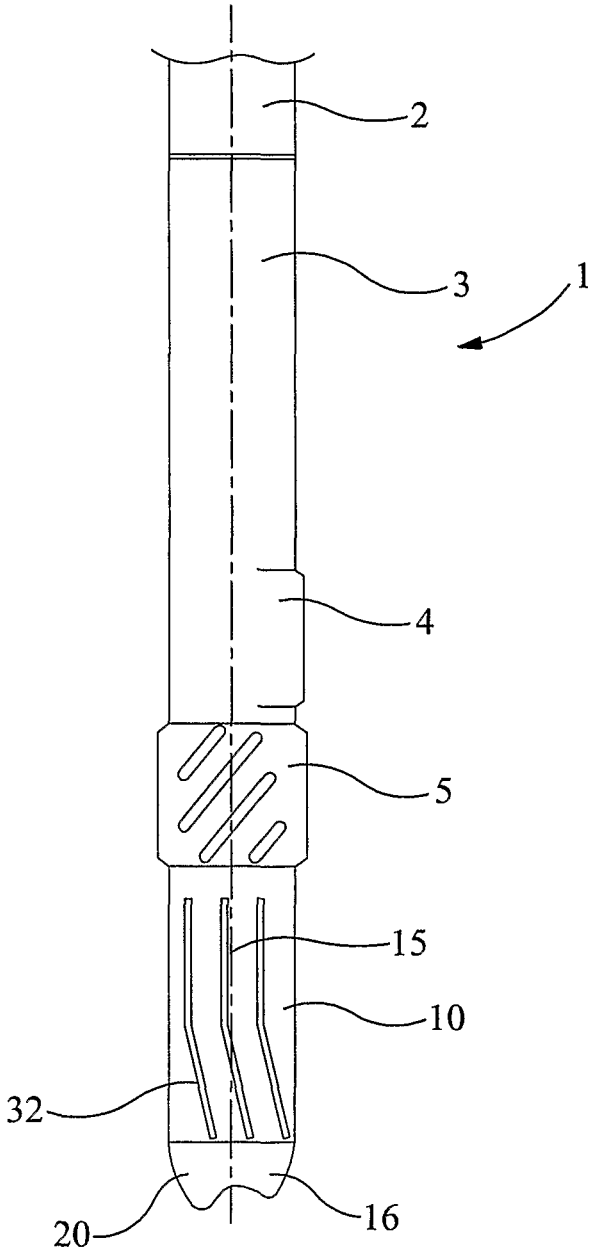
FIG. 3 shows an apparatus for running a bore-lining tubular according to another aspect of the present invention.

In reference now to FIG. 3 of the drawings, there is shown an assembly 1 for running a bore-lining tubular 2 according to an embodiment of the present invention. Only the lower portion of the tubular 2 is shown, though the tubular 2 may form part of tubular string. The assembly 1 comprises a reamer shoe similar to the shoe 10 described in relation to FIGS. 1, 2A and 2B and like components are indicated by like numerals. The shoe 10 of FIG. 3 shows a further, alternative reaming rib arrangement to the arrangements shown in FIGS. 2A and 2B.

The assembly 1 further comprises a mud-powered motor 3 adapted to rotate the reamer shoe 10 and the reamer shoe 10 is coupled to the motor 3 via a connector sub 4.

The assembly 1 further comprises a stabiliser 5 located on the reamer shoe 10. The stabiliser 5 is non-rotating or free to rotate relative to the reamer shoe 10. Although one stabiliser is shown, it will be recognised that a plurality of stabilisers 5 may be provided at spaced locations on the assembly 1 as required.

In use, the reamer shoe 10 is coupled to the tubular component 2 and run into a wellbore or tubular component to be reamed (not shown). The lobe 20 enables the shoe 10 to stab or cut through an obstruction (not shown) in the wellbore or tubular component without rotation, where required.

The motor 3 is operated to rotate the reamer shoe 10 relative to the tubular component 2 and the stabiliser 5. For example, the shoe 10 is adapted to rotate at speeds of up to about 1000 rpm. This facilitates efficient reaming operation while reducing rotational forces on the tubular component 2. The motor 3 is adapted to rotate the shoe 10 at significantly higher speeds than would typically be used when rotating drill string or casing. Higher rotational speeds may be used to facilitate more efficient reaming operations such that a less complex motor can be used. The balanced nose 16 permits high speed rotation while mitigating or substantially eliminating vibration generated by forces produced from rotation of the nose 16 about the central axis 15 which may otherwise be transmitted to the assembly 1.

The ribs 32 engage the interior surface of the wellbore or tubular component, rotation of the shoe 10 reaming the wellbore to the required dimension and surface texture. The abrasive particles provided on the ribs and nose further assist in performing the operation.

On completion of the reaming operation, the shoe 10 can be drilled through to permit extension of the bore or permit location of tools or pipe through the bore. At least some of the components of the reaming shoe 10 are sacrificial, that is they are suitable for drilling through. The substantially concave portion 17 and dimple 19 assist in avoiding the creation of an unsupported portion of the nose 16 which may otherwise be left in the bore to act as a further obstruction in the bore. The dimple 19 is arranged such that, where the nose 16 is subject to a drill through operation by a drilling tool (not shown), the drilling tool engages the dimple 19, this facilitating gradual cutting away of the dimple 19 and the nose 16 by the drilling tool. In the absence of such a projection, drilling through a tapering nose 16 may result in the nose wall being cut through, leaving an unsupported end portion or slug of material which without restraint could form an obstruction in the bore.

It should be understood that the embodiments described are merely exemplary of the present invention and that various modifications may be made without departing from the scope of the invention.

For example, while the embodiment described above relates to reaming a wellbore, the shoe may be used to ream a tubular component such as casing, liner or other downhole tubular component. Alternatively, the shoe may be used in reaming any bore, including for example as may be formed to access a geothermal formation or the like.

What is claimed is:

1. A reaming shoe for location in a bore, the shoe comprising a rotationally balanced nose;

a rotary drive rotationally coupled to the reaming shoe to enable reaming of the bore, the rotary drive enabling rotation of the reaming shoe at speeds of at least 1,000 revolutions per minute, the reaming shoe coupled to a lowermost part of a bottom hole assembly;

wherein the reaming shoe and rotary drive are configured to be coupled to a tubular component, and wherein the reaming shoe and rotary drive are mounted to the tubular component to enable rotation of the reaming shoe independently of the tubular component, such that the reaming shoe is rotatable at a different rotational speed than the tubular component; and wherein the reaming shoe is configured to be drilled through after being emplaced in the bore, the nose of the reaming shoe comprising an eccentric profile, the eccentric profile comprising at least one internal convex geometric feature to enable drilling the reaming shoe substantially without cutting through a side wall of the reaming shoe and without creating an unsupported end portion of the reaming shoe during drilling the reaming shoe.

2. The reaming shoe of claim 1, wherein the eccentric profile defines an off-center portion, the off-center portion defining an off-center mass relative to an axis of the reaming shoe.

3. The reaming shoe of claim 1, wherein the reaming shoe comprises a body, and wherein at least one of:

the body defines a conduit for directing fluid through the shoe;

the body and the nose comprise a single component;

the nose comprises a separate component configured to be coupled to the body;

the nose is adapted to be coupled to the body by at least one of a threaded connector, mechanical fastener, spline connection, hexagonal drive, fused connection, brazing, and adhesive; and the nose is constructed from at least one of a metallic material, a metallic alloy, a ceramic material, a polymeric material, and a glass material.

4. The reaming shoe of claim 1, wherein the reaming shoe comprises a weighting arrangement adapted to rotationally balance the nose about an axis of the shoe.

5. The reaming shoe of claim 4, wherein the weighting arrangement comprises at least one of a bore and an insert provided in at least one reaming element of the shoe to facilitate rotational balancing of the nose.

6. The reaming shoe of claim 4, wherein the weighting arrangement comprises at least one of:

at least one insert provided on the nose;

at least one insert provided on a body of the reaming shoe;

at least one insert provided on an opposing side of the nose from an eccentric portion thereof;

at least one insert comprising at least one of a bar, a slug and pellet of material of higher density than a density of the reaming shoe body; and at least one bore defining a void, wherein the bore is provided in at least one of the body and the nose.

7. The reaming shoe of claim 4, wherein the weighting arrangement comprises a portion of the nose formed and arranged to rotationally balance a mass of the nose about the reaming shoe axis.

8. The reaming shoe of claim 7, wherein the weighting arrangement nose portion is formed with the nose as an integral cast-in feature.

9. The reaming shoe of claim 1, wherein the reaming shoe comprises at least one reaming element.

10. The reaming shoe of claim 9, wherein at least one of:

the at least one reaming element is provided on at least one of a body of the reaming shoe and the nose;

the at least one reaming element comprises at least one of a reaming rib and reaming blade;

the at least one reaming element further comprises a cutting surface; and the at least one reaming element extends around at least a portion of the circumference of a body of the reaming shoe or extends axially relative to the shoe.

11. The reaming shoe of claim 1, wherein at least one of:

the nose defines a conduit for directing fluid through the shoe;

the nose further comprises at least one port for permitting fluid to be directed to the exterior of the shoe.

12. The reaming shoe of claim 11, wherein at least one of:

the at least one port comprises at least one nozzle;

the at least one port is integrally formed in the nose; and the at least one port comprises a separate component coupled to the nose.

13. The reaming shoe of claim 1, wherein at least one of:

the nose comprises at least one cutting structure;

the nose further comprises selected regions of weakness; and the nose defines a substantially concave distal surface.

14. The reaming shoe of claim 1, wherein the rotary drive comprises at least one of a mud powered motor and an electric motor.

15. The reaming shoe_of claim 1, further comprising at least one stabilizer.

* * * * *